US007481581B2

(12) United States Patent
Oshima et al.

(10) Patent No.: US 7,481,581 B2
(45) Date of Patent: Jan. 27, 2009

(54) PACKAGING BAG

(75) Inventors: Shigeyuki Oshima, Chiyoda-ku (JP); Yoshiji Moteki, Chiyoda-ku (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 715 days.

(21) Appl. No.: 10/527,794

(22) PCT Filed: Sep. 25, 2003

(86) PCT No.: PCT/JP03/12269

§ 371 (c)(1),
(2), (4) Date: Mar. 15, 2005

(87) PCT Pub. No.: WO2004/028913

PCT Pub. Date: Apr. 8, 2004

(65) Prior Publication Data

US 2006/0072861 A1 Apr. 6, 2006

(30) Foreign Application Priority Data

Sep. 25, 2002 (JP) ..... 2002-279782

(51) Int. Cl.
*B65D 33/00* (2006.01)
*B65D 30/08* (2006.01)

(52) U.S. Cl. ..... 383/200; 383/116

(58) Field of Classification Search ..... 383/201, 383/208, 209, 200, 207, 116
See application file for complete search history.

(56) References Cited

U.S. PATENT DOCUMENTS 3,608,815 A * 9/1971 Bunch ..... 383/201
4,139,643 A * 2/1979 Hix et al. ..... 426/122
4,778,058 A * 10/1988 Yamazaki et al. ..... 383/200
4,903,841 A * 2/1990 Ohsima et al. ..... 383/200
RE33,880 E * 4/1992 Yamazaki et al. ..... 383/200

(Continued)

FOREIGN PATENT DOCUMENTS

JP 7-165243 6/1995

(Continued)

*Primary Examiner*—Jes F Pascua
(74) *Attorney, Agent, or Firm*—Steptoe & Johnson LLP

(57) ABSTRACT

A packaging bag is formed by bending a laminate film at two portions in parallel to each other such that both end portions thereof are mated to each other and the mated end portions are bonded together so as to provide a tubular body having upper and lower openings, which are sealed by forming upper and lower seal portions, respectively. In such packaging bag, the two bent portions 15 and 16 of the laminate film constitute side edge portions as boundary portions between a front surface portion 2 and a back surface portion 3 of a packaging bag, the upper seal portion 5 is formed with a rough surface seal open portion 10 formed with aggregation of a plurality of fine recesses formed to an outer layer constituting the laminate film and a plurality of fine through holes penetrating the outer layer so that the rough surface seal open portion is formed to the front surface and/or back surface portion of the packaging bag so as to include one of the side edge portions thereof, and the rough surface seal open portion 10 is formed in the upper seal portion 5 such that a lower end of the rough surface seal open portion is apart upward from a lower end of the upper seal portion 5.

5 Claims, 10 Drawing Sheets

U.S. PATENT DOCUMENTS

| | | | | |
|---|---|---|---|---|
| 5,222,813 | A * | 6/1993 | Kopp et al. | 383/200 |
| 5,984,088 | A * | 11/1999 | Dietz et al. | 206/205 |
| 6,102,571 | A * | 8/2000 | Moteki et al. | 383/208 |
| 6,352,364 | B1 * | 3/2002 | Mobs | 383/200 |
| 6,726,363 | B1 * | 4/2004 | Marbler et al. | 383/200 |
| 7,111,986 | B2 * | 9/2006 | Marbler et al. | 383/200 |
| 7,207,719 | B2 * | 4/2007 | Marbler et al. | 383/200 |
| 2004/0190800 | A1 * | 9/2004 | Peron et al. | 383/200 |

FOREIGN PATENT DOCUMENTS

| | | |
|---|---|---|
| JP | 2000-103437 | 4/2000 |
| WO | 2004/028913 A1 | 4/2004 |

* cited by examiner 3
4
5
6
7
8
9
10
11
15
16

PACKAGING BAG

FIELD OF THE INVENTION

The present invention relates to a packaging bag having a rough surface portion for opening.

BACKGROUND ART

In a conventional art, there have been provided various techniques for easily opening a packaging bag containing powder or liquid, such as by forming a cutout or like to a side edge portion of the packaging bag. However, the formation of such cutout will damage an outer appearance of the packaging bag, and in addition, fear of erroneously opening the packaging bag will also be increased.

In order to eliminate such defect, the inventor of the subject application had already disclosed a packaging bag provided with a rough surface portion at a opening-start point (see Japanese Patent Application No. 2001-140543). Further, it is to be noted that the term of "rough surface portion", used herein, means a coagulated structure of a plurality fine recesses formed to an outer layer constituting a laminate film and a plurality of fine through holes formed thereto so as to penetrate the outer layer. By providing such rough surface portion to the side edge portion of a packaging container, the strength of such rough surface portion is weakened to thereby easily open the packaging bag from this rough surface portion.

An invention of a packaging bag formed with such rough surface portion is disclosed other than the above patent application (for example, refer to Japanese Patent Unexamined Laid-open Publication No. 2002-211584).

However, in the packaging bag provided with such rough surface portion, there is a fear of slightly deteriorating barrier performance of the packaging bag at that portion in comparison with the other portions. Especially, at a time when the laminate film is pulled, while being drawn by a former of an automatic packaging machine, an excessive force is partially applied to the laminate film, and a portion subjected to surface roughing working, another film portion constituting the laminate film, or aluminium foil will be expanded, thus deteriorating the barrier performance.

In addition, in such packaging bag, particular material, in place of liquid material, may be contained in the packaging bag, and when the particular material is contained in the packaging bag, there is a fear that the particular material clogs a material pouring portion, preventing smooth pouring.

DISCLOSURE OF THE INVENTION

The present invention was conceived in consideration of the matters mentioned above, and an object of the present invention is to provide a packaging bag provided with rough surface portion improved so as to easily open the packaging bag and with superior barrier performance.

The present invention provides, to achieve such object, a packaging bag formed by bending a laminate film at two portions in parallel to each other such that both end portions thereof are mated to each other and the mated end portions are bonded so as to provide a tubular body having upper and lower openings, which are sealed by forming upper and lower seal portions, respectively, wherein the two bent portions of the laminate film constitute side edge portions as boundary portions between a front surface portion and a back surface portion of a packaging bag, the upper seal portion is formed with a rough surface seal open portion formed from aggregation of a plurality of fine recesses formed to an outer layer constituting the laminate film and a plurality of fine through holes penetrating the outer layer so that the rough surface seal open portion is formed to the front surface and/or back surface portion of the packaging bag so as to include one of the side edge portions thereof, and the rough surface seal open portion is formed in the upper seal portion such that a lower end of the rough surface seal open portion is apart upward from a lower end of the upper seal portion.

According to this invention, since the rough surface seal open portion is formed to the side edge portion of the packaging bag formed by bending the laminate film, the packaging bag can be easily opened. In addition, the rough surface seal open portion is formed with aggregation of a plurality of fine recesses formed to the outer layer constituting the laminate film and a plurality of fine through holes penetrating the outer layer such that the rough surface seal open portion is formed to be apart upward from the lower end edge of the upper seal portion so as to be isolated from the inner content accommodation space. Accordingly, the formation of such rough surface seal open portion does not adversely influence to the accommodation space, and the packaging bag having extremely improved barrier performance can be provided.

In this invention, the mated end portions are bonded with a predetermined width at the back surface side of the packaging bag so as to form a back seal portion, the upper seal portion includes a first seal portion formed in a width direction of the packaging bag from one side edge thereof and having a relatively deep depth in a vertical direction of the front and back surface portions and a second seal portion formed between the first seal portion and another side edge of the packaging bag in the width direction thereof and having a relatively shallow depth, compared with the first seal portion, in a vertical direction of the front and back surface portions, the rough surface seal open portion is formed in the first seal portion, and an intermediate rough surface seal open portion is formed with aggregation of a plurality of fine recesses formed to the outer layer constituting the laminate film and a plurality of fine through holes penetrating the outer layer so that the intermediate rough surface seal open portion is formed, in the back surface portion, to a root portion of the back seal portion facing the another side edge portion of the packaging bag.

According to the packaging bag having such structure as mentioned above, the intermediate rough surface seal open portion serves as intermediary portion for opening the packaging bag. Therefore, the packaging bag can be smoothly opened without being interrupted at the back seal portion. In addition, such intermediate rough surface seal open portion is formed in the first seal forming area, so that the intermediate rough surface seal open portion is completely independent from the inner content accommodation space. Thus, the packaging bag having highly improved barrier performance can be provided.

Furthermore, the above-mentioned object can be achieved according to the present invention by providing a packaging bag formed by bending a laminate film into two portions so as to provide a bent portion as one side edge portion constituting a boundary of a front surface portion and a back surface portion of a packaging bag and forming seal portions by bonding the front surface portion and the back surface portion of the packaging bag at three side edge portions other than the one side edge portion thereof, wherein the three seal portions includes an upper seal portion, which is formed with a rough surface seal open portion formed with aggregation of a plurality of fine recesses formed to an outer layer constituting the laminate film and a plurality of fine through holes penetrating the outer layer so that rough surface seal open portion is formed to the front surface and/or back surface portion of the packaging bag so as to include the bent portion forming the side edge portion, and the rough surface seal open portion is formed in the upper seal portion such that a lower end of the rough surface seal open portion is apart upward from a lower end of the upper seal portion.

According to this invention, since the rough surface seal open portion is formed to the side edge portion of the packaging bag formed by bending the laminate film, the packaging bag can be easily opened. In addition, the rough surface seal open portion is formed with aggregation of a plurality of fine recesses to be apart upward from the lower end edge of the upper seal portion so as to be isolated from the inner content accommodation space. Accordingly, the formation of such rough surface seal open portion does not adversely influence to the accommodation space and the packaging bag having extremely improved barrier performance can be provided.

In this invention, the upper seal portion includes a first seal portion formed in a width direction of the packaging bag from the bent portion and having a relatively deep depth in a vertical direction of the front and back surface portions and a second seal portion formed between the first seal portion and another side edge of the packaging bag opposing to the one side edge formed as bent portion in the width direction thereof and having a relatively shallow depth, compared with the first seal portion, in a vertical direction of the front and back surface portions, and the rough surface seal open portion is formed in the first seal portion.

According to this invention, first, the packaging bag can be easily opened. In addition, since the rough surface seal open portion is formed in the first seal forming area, this rough surface seal open portion is completely independent from the accommodation space in which the inner content is accommodated, and for this reason, the packaging bag having extremely improved barrier performance can be provided.

Secondarily, when the packaging bag is opened, the lower portion of the second seal portion serves as pouring section through which the inner content accommodated in the accommodation space of the packaging bag is communicated to the external portion thereof.

Still furthermore, according to the present invention, there is further provided a packaging bag formed by bending a laminate film at two portions in parallel to each other such that both end portions thereof are mated to each other and the mated end portions are bonded so as to provide a tubular body having upper and lower openings, which are sealed by forming upper and lower seal portions, respectively, wherein the two bent portions of the laminate film constitute side edge portions as boundary portions between a front surface portion and a back surface portion of a packaging bag so that the mated end portions is bonded with a predetermined width at the back surface side of the packaging bag so as to form a back seal portion, the upper seal portion includes a first seal portion formed in a width direction of the packaging bag from one side edge thereof to a portion near the back seal portion and having a relatively deep depth in a vertical direction of the front and back surface portions and a second seal portion formed between the first seal portion and another side edge of the packaging bag in the width direction thereof and having a relatively shallow depth, compared with the first seal portion, in a vertical direction of the front and back surface portions, the first seal portion is formed with a rough surface seal open portion formed with aggregation of a plurality of fine recesses formed to an outer layer constituting the laminate film and a plurality of fine through holes penetrating the outer layer so that the rough surface seal open portion is formed to the front surface and/or back surface portion of the packaging bag so as to include one of the side edge portions thereof, and an intermediate rough surface seal open portion is formed with aggregation of a plurality of fine recesses formed to the outer layer constituting the laminate film and a plurality of fine through holes penetrating the outer layer so that the intermediate rough surface seal open portion is formed, in the back surface portion, to a root portion of the back seal portion facing the another side edge portion of the packaging bag.

According to the structure of the packaging bag mentioned above, the packaging bag provided with a large pouring section can be provided.

Moreover, according to the present invention, there is further provided a packaging bag formed by bending a laminate film at two portions in parallel to each other such that both end portions thereof are mated to each other and the mated end portions are bonded so as to provide a tubular body having upper and lower openings, which are sealed by forming upper and lower seal portions, respectively, wherein the two bent portions of the laminate film constitute side edge portions as boundary portions between a front surface portion and a back surface portion of a packaging bag so that the mated end portions is bonded with a predetermined width at the back surface side of the packaging bag so as to form a back seal portion, the upper seal portion includes a first seal portion formed in a width direction of the packaging bag from one side edge thereof to a portion near the back seal portion and having a relatively deep depth in a vertical direction of the front and back surface portions and a second seal portion formed between the first seal portion and another side edge of the packaging bag in the width direction thereof and having a relatively shallow depth, compared with the first seal portion, in a vertical direction of the front and back surface portions, a rough surface seal open portion is formed with aggregation of a plurality of fine recesses formed to an outer layer constituting the laminate film and a plurality of fine through holes penetrating the outer layer so that the rough surface seal open portion is formed to the front surface and/or back surface portion of the packaging bag between the lower end edge of the first seal portion and the lower end edge of the second seal portion in the vertical direction of the packaging bag so as to include the another side edge portions thereof, and an intermediate rough surface seal open portion is formed with aggregation of a plurality of fine recesses formed to the outer layer constituting the laminate film and a plurality of fine through holes penetrating the outer layer so that the intermediate rough surface seal open portion is formed, in the back surface portion, to a root portion of the back seal portion facing the one side edge portion of the packaging bag.

With the packaging bags mentioned above, it is desirable that the rough surface seal open portion is formed so as to gradually protrude towards a central portion in the width direction of the packaging bag from upper and lower end portions in the vertical direction of the rough surface seal open portion.

Furthermore, it may be also desired that the rough surface seal open portion is provided with a portion, at which the recesses are formed coarsely in density, along a peripheral edge portion of the rough surface seal open portion, at which the recesses having a relatively shallow depth are formed, along a peripheral edge portion of the rough surface seal open portion, or at which the recesses having a relatively small size are formed, along a peripheral edge portion of the rough surface seal open portion.

BEST MODE FOR EMBODYING THE INVENTION

The exemplary embodiment of the present invention will be described hereunder with reference to the accompanying drawings.

Figure 1:
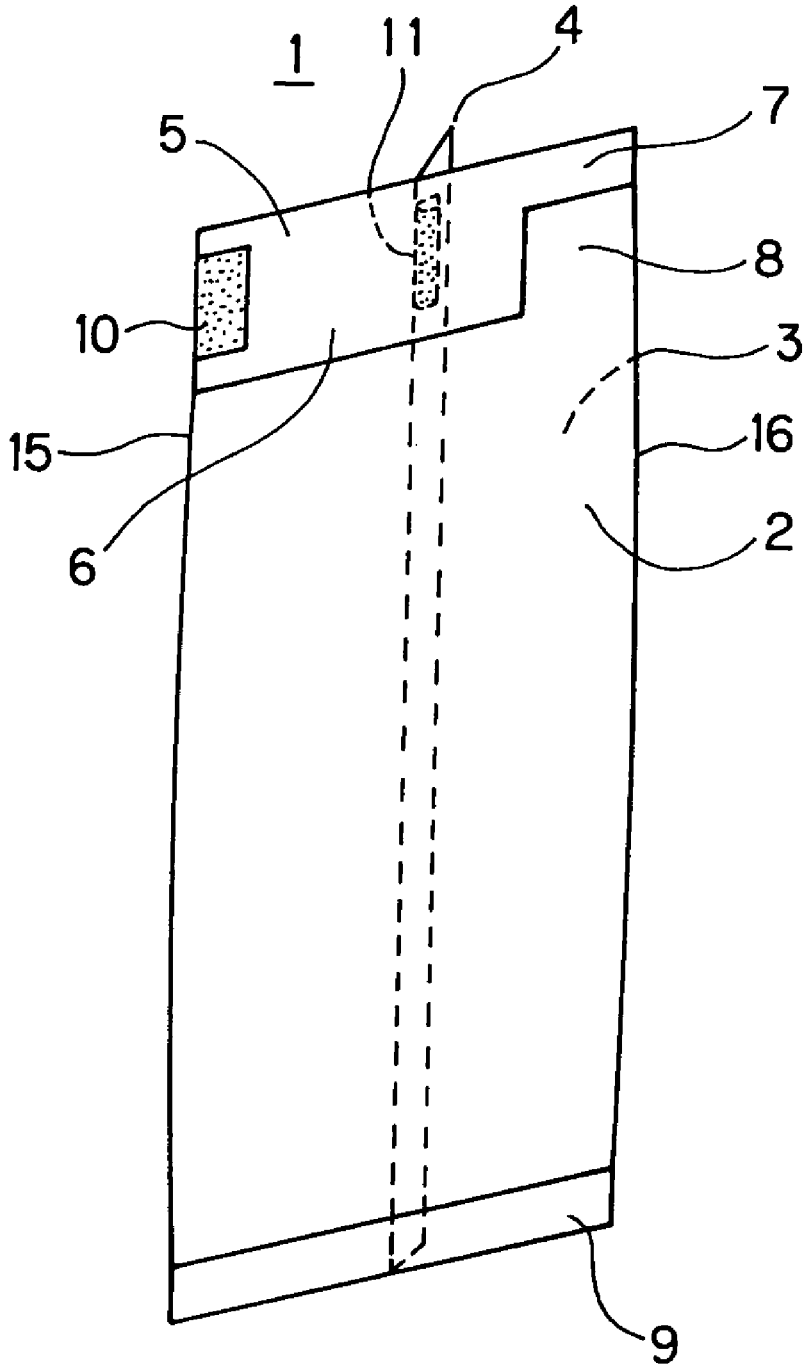
FIG. 1 is a perspective view of a packaging bag of pillow type according to one embodiment of the present invention.
Figure 2:
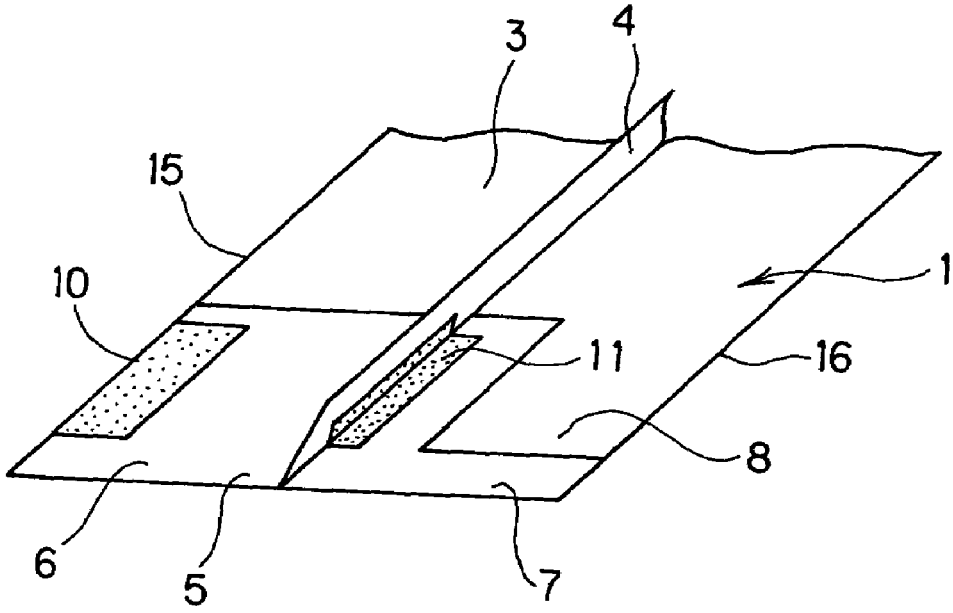
FIG. 2 is a perspective view showing a portion near an intermediate rough surface portion formed to a back surface of the packaging bag shown in FIG. 1.

FIGS. 1 and 2 show a packaging bag 1 according to one embodiment of the present invention. This packaging bag 1 is formed first by bending a sheet of laminate film at two portions so that the bend lines are parallel to each other and one side end portion abuts against the other side end portion of the sheet of film material, then bonding the abutting both end portions together so as to provide a tubular body, and closing and sealing both upper and lower open end portions of the tubular body.

The packaging bag 1 has a front surface portion 2 and a back surface portion 3 opposing to the front surface portion 2, and upper and lower seal portions 5 and 9 are formed at the upper and lower end edge portions of the packaging bag 1, by heat-sealing the front and back surface portions 2 and 3, along the upper and lower end edge portions, respectively. Further, both the bending (bent) portions 15 and 16 of the film material are formed as both side edge portions of the packaging bag 1, and thus, the packaging bag 1 is sectioned to the front surface portion 2 and the back surface portion 3 with these bent portions 15 and 16 being boundaries therebetween.

The back surface portion 3 is formed with a back seal portion 4 formed, by mating and bonding both side edge portions of the film material so that the back seal portion 4 extends in a vertical direction as viewed. This back seal portion 4 is formed at substantially central portion in the width direction of the packaging bag 1 so as to extend outward the packaging bag 1.

The lower seal portion 9 closing the lower portion of the packaging bag 1 is formed by heat-sealing the front and back surface portions 2 and 3 at a predetermined width from the lower end edge portion along the entire width direction of the packaging bag 1. On the other hand, the upper seal portion 5 closing the upper portion of the packaging bag 1 is formed so as to have two-staged portion having deep seal portion and shallow seal portion of the seal portion from the upper end edge of the packaging bag 1 in the width direction thereof. The deep seal portion is formed as a first seal portion 6, which occupies an area having about 70% length portion from one side edge portion of the packaging bag 1 in its width direction and has a relatively long depth from the upper end edge thereof. On the other hand, the shallow seal portion is formed as a second seal portion 7, which occupies an area between the first seal portion 6 and the other side edge of the packaging bag 1 and has a relatively short depth from the upper end edge hereof.

The packaging bag 1 of the structure mentioned above has a space portion, formed between the upper seal portion 5 formed to the upper portion of the packaging bag 1 and the lower seal portion 9 formed to the lower portion thereof, as an inner accommodation space into which content is accommodated. Further, a portion or area 8 of the content accommodation space extending upward is formed as pouring section 8 for pouring outward the inner content, though mentioned in detail hereinlater.

The first seal portion 6 having the deep seal portion is formed with a rough surface portion 10 from which a sealed portion is easily torn and opened, which will be called herein "rough surface seal open portion 10", at the bent portion 15 of one side edge portion of the packaging bag 1. This rough surface seal open portion 10 is a sealed portion formed with the rough surface portion for easily opening the packaging bag 1 therefrom, thus constituting a starting portion for breaking and opening the sealed portion of the packaging bag 1. The rough surface seal open portion 10 is hence formed in the range or area of the first seal portion 6, as the deep seal portion, so as to include the bent portion 15 at one side edge portion of the packaging bag 1. In the packaging bag 1 shown in FIG. 1, such rough surface seal open portion 10 is formed to each of the front surface portion 2 and the back surface portion 3 with the bent portion 15 being the center thereof. However, it is not always necessary to form the rough surface seal open portions 10 to both the front and back surface portions 2 and 3, as long as the bent portion 15 is included, and the rough surface seal open portion 10 may be formed only to either one of the front and back surfaces 2 and 3 of the packaging bag 1.

In addition, an intermediate rough surface portion 11 is further formed to a root portion of the back seal portion 4 in the area in which the first seal portion 6 is formed. This intermediate rough surface portion 11 is a portion for preventing the seal opening operation starting from the rough surface seal open portion 10 from being interrupted there. The intermediate rough surface portion 11 is, as shown in FIG. 2, is formed to the root portion of the back seal portion 4 facing to the bent portion 16 of the other side edge of the packaging bag 1, opposite to the bent portion 15 formed to one side edge thereof at which the rough surface seal open portion 10. According to such formation of the intermediate rough surface portion 11, the intermediate rough surface portion 11 is formed to the root portion of the back seal portion 4 on the side of the other bent portion 16, so that this intermediate rough surface portion 11 acts as an intermediate seal-open starting portion for opening the packaging bag 1.

Further, the rough surface seal open portion 10 formed on the side of the one bent portion 15 and the intermediate rough surface portion 11 formed to the root portion of the back seal portion 4 have upper ends of a level in height of the packaging bag 1 substantially coincident with the position level of the pouring section 8 formed in the section at which the second seal portion 7 is formed.

Figure 3:
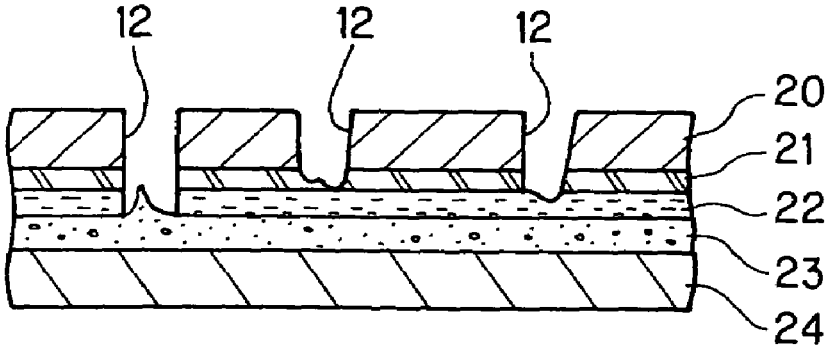
FIG. 3 is a schematic sectional view, in an enlarged scale, of a film material at the rough surface seal open portion (which is a rough surface portion from which a seal portion is easily opened) and the intermediate rough surface portion of the packaging bag.

FIG. 3 is a sectional view, in an enlarged scale, of the layer structure of the film material, forming the packaging bag 1, taken along the line including the rough surface seal open portion 10 and the intermediate rough surface portion 11. As shown in FIG. 3, as the film material, is used a laminate film composed of a plurality of layers. The film material includes a PET (polyethylenetelephthalate) film 20 as a base and a PE (polyethylene) film 24 as inner layer, both being bonded as lamination layer by a bonding agent 23. The PET film 20 constituting an outer layer has an inner surface to which a PVDC (polyvinylden chloride) coat 21 so as to endow a barrier performance to the film material. A printing ink layer 22 is further applied to the inside of the PVDC coat 21 for describing letters or figures to the packaging bag 1. The bonding agent 23 is disposed between the printing ink layer 22 and the PE film 24.

The PET film 20 forming the outer layer is formed from a biaxially orientated PET having a film thickness of 12 μm, and the PVDC having a film thickness of about 3 μm is coated as PDVC coat 21 to the inner surface of the PET film 20. On the other hand, the PE film 24 forming the inner layer is formed from a PE having a film thickness of 70 μm. A dry laminate bonding agent or bonding agent including no solvent may be utilized as bonding agent 23 bonding the outer and inner layers together. An extrusion laminate technology for the PE may be utilized in place of the dry laminate technology.

In the embodiment shown in FIG. 3, although the PVDC coat 21 is disposed on the inner layer side of the PET film 20, an evaporation layer may be formed by evaporating metal such as $Al_2O_3$, $SiO_2$ or like on the inner surface of the PET film 20, and in this alternation, high barrier performance can be achieved. Furthermore, in order to obtain extremely high barrier performance, an aluminium foil or EVOH (ethylene-polyvinyl-alcohol copolymer) layer may be provided for each base layer film.

The rough surface seal open portion 10 and the intermediate rough surface portion 11 are formed to the outer layer of the lamination film material as portions each including a plurality of fine recesses and through holes only penetrating the outer layer (the recesses and through hole are denoted with reference numeral 12) and formed as coagulated portion (i.e., aggregation) of such recesses and through holes. As shown in FIG. 3, the respective recessed portions and through holes 12, 12, - - - , 12 constituting the rough surface seal open portion 10 and the intermediate rough surface portion 11 are formed so that at least the PE film 24 constituting the innermost layer remains unremoved from the PET film 20 side constituting the outermost layer of the film material. These rough surface seal open portion 10 and the intermediate rough surface portion 11 are formed by pressing a sand paper of #80 to # 180 against the film material from the outer layer side. Further, the intermediate rough surface may be formed by forming sewn line area (dotted line area) from the outer layer side.

The packaging bag 1 having the structure mentioned above has an inner content accommodation space between the upper seal portion 5 formed to the upper portion thereof and the lower seal portion formed to the lower portion thereof. Since the rough surface seal open portion 10 and the intermediate rough surface portion 11 are formed in the area of the first seal portion 6 as deep sealed portion, these rough surface portions 10 and 11 are positioned apart from the content accommodation portion of the packaging bag 1. For this reason, the content accommodation portion is not influenced with the formation of such rough surface seal open portion 10 and the intermediate rough surface portion 11, and the extremely high barrier performance can be realized and maintained.

Figures 4A, 4B, 4C, 4D:
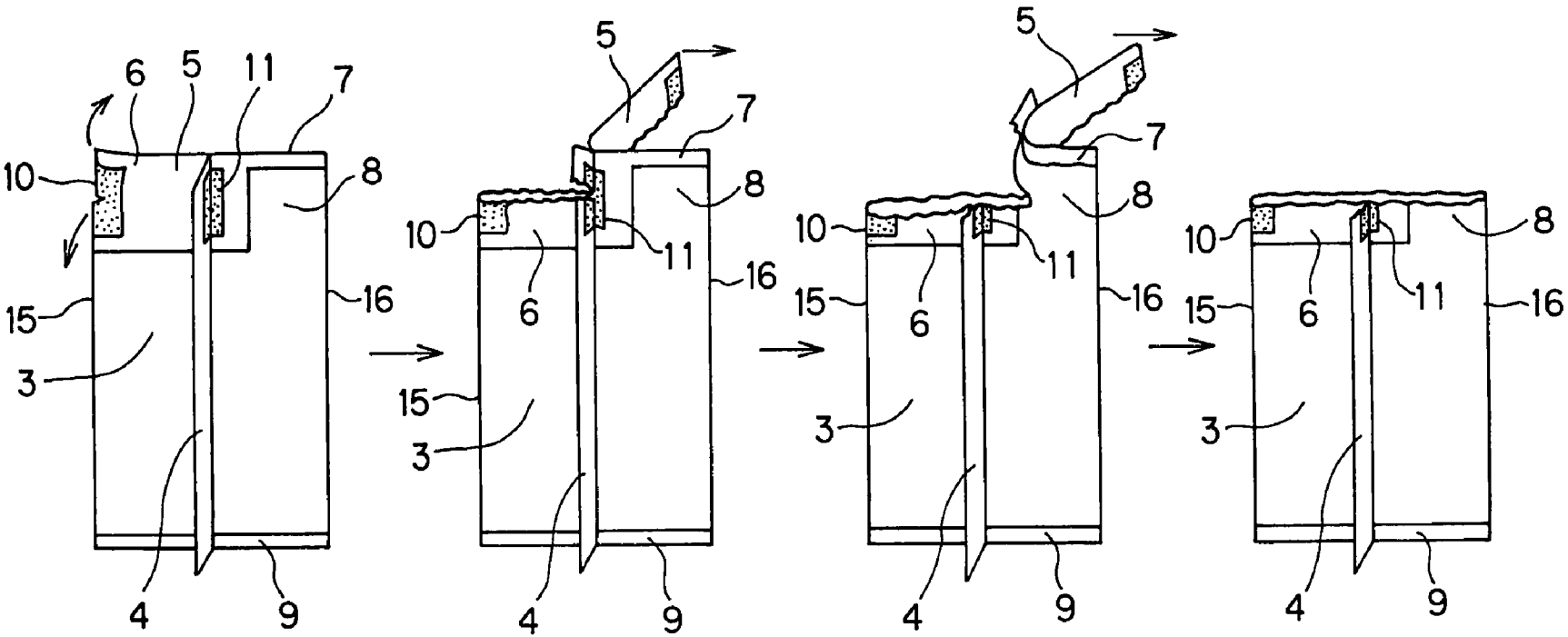
FIG. 4 includes views showing opening steps of the packaging bag of FIG. 1.

The packaging bag 1 is, as shown in FIG. 4, opened, at its upper portion, with the rough surface seal open portion 10 as opening starting point. First, the opening operation starts from the rough surface seal open portion 10 by tearing this portion 10 by hand (FIG. 4(*a*)). As the opening operation is continued, the tearing front end reaches the back seal portion 4 (FIG. 4(*b*)), which has the root portion to which the intermediate rough surface portion 11 is formed. Since this intermediate rough surface portion 11 is formed to the portion of the back seal portion 4 on the side facing the bend portion 16 opposite to the rough surface seal-open portion 10, the intermediate rough surface portion 11 acts as, a further seal-opening starting point. For this reason, the seal opening operation to the back seal portion 4 can smoothly progress. Thereafter, the opening further progresses, the seal opening motion passes the first seal portion 6 as the deep seal portion and the tearing front end reaches the pouring section 8 formed to the upper end portion of the inner content accommodation space formed in the area of the second seal portion 7 (FIG. 4(*c*)). The opening operation reaches the other side edge of the packaging bag 1, the pouring section 8 is opened so as to communicate the accommodation space with the outside portion to thereby take out the inner content (FIG. 4(*d*)).

Any kind of liquids, powders or the like can be accommodated in this packaging bag 1. The liquids to be contained include seasonings having relatively low viscosity such as soy or seasonings having relatively high viscosity such as sauce, mayonnaise, ketchup and the like. Liquid medicine or chemicals may be accommodated in this packaging bag 1. The powders to be contained include powder seasonings such as powder soup, pepper and the like, or powder or granular medicine. Thus, the packaging bag 1 is suitable for accommodating contents which requires high barrier performance.

In the above descriptions, although pillow-type packaging bags each in which the bent portions of the film material are positioned on the side edges and the back seal portion is formed to the back side surface of the film material, the packaging bag of the present invention is not limited to such pillow-type.

Figure 5:
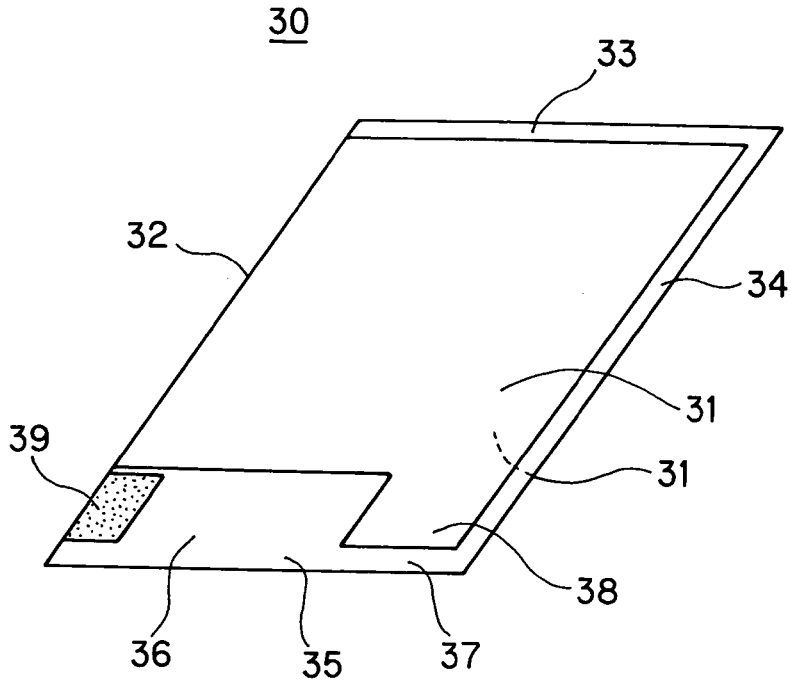
FIG. 5 is a perspective view of a packaging bag according to an embodiment, other than that shown in FIG. 1, according to the present invention.
Figure 6:
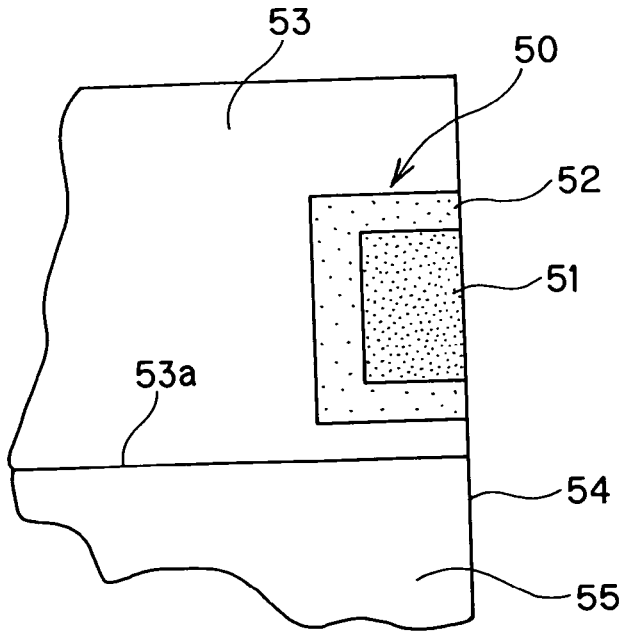
FIG. 6 is a plan view showing the rough surface seal open portion having a recessed portion surrounding the other portion along a peripheral edge thereof, the recessed portion having a density relatively thinner than that of the other portion.

FIG. 5 represents a packaging bag 30 which has one bent side edge as bent portion 32 of the film material and other three sides which are sealed. This packaging bag 30 is formed by bending a sheet of film material at one side so as to provide two flat surface portions 31, 31. This packaging bag 30 is provided with one side end edge which is bent as bent portion 32 and the other side end edge at which the flat portions 31, 31 are sealed, as seal portion 34, with a predetermined width.

The packaging bag 30 has a lower end portion at which the flat portions 31, 31 are sealed, as seal portion 33, along the end edge thereof with a predetermined width. On the other hand, the packaging bag 30 also has an upper end portion at which two-staged seal portion 35 having deep seal portion and shallow seal portion having different depths from the upper end edge in the width direction of the packaging bag 30. The deep seal portion of the packaging bag 30, as like as the packaging bag 1, is formed as a first seal portion 36, which occupies an area having about 70% length portion from one side edge portion of the packaging bag 30 in its width direction and has a relatively deep depth from the upper end edge thereof. On the other hand, the shallow seal portion is formed as a second seal portion 37, which occupies an area between the first seal portion 6 and the other side edge of the packaging bag 1 and has a relatively shallow depth from the upper end edge hereof.

The packaging bag 30 is formed with an inner accommodation section as a hollow space which is defined by the seal portions 33, 34, 35 which seal three side edge portions of the packaging bag 30 and the bent portion 32. Further, the section of this space in the second seal portion 37 projecting upward towards the upper edge portion is formed as a pouring section 38 through which the inner content is poured.

Furthermore, a rough surface seal open portion 39 is formed to the bent portion 32 in the deep-sealed first seal portion 36. This rough surface seal open portion 39 is also formed as in the former example as an aggregation of a plurality of fine recessed portions formed by pressing a sand paper having # 80 to # 180 or like against the outer layer side portion of the film material. In this packaging bag 30, as like as the former packaging bag 1, the rough surface seal open portion 39 formed on the one side edge of the bag 30 has an upper side portion in the same level as that of the pouring section 38 formed to portion having the second seal portion 37.

The opening of such packaging bag 30 is performed by tearing the upper portion of the bag 30 along the width direction from the rough surface seal open portion 39 as seal opening starting point to thereby open the pouring section 38, through which the inner content can be poured outside.

Further, it is to be noted that, in the packaging bag 1 and the packaging bag 30 described hereinabove, the rough surface seal open portions may be formed in shapes as shown in FIGS. 6 to 10.

A rough surface seal open portion 50 is composed of a fine recessed or concave portions formed to the outer layer of the laminate film and through hole portions 51 and 52 penetrating only the outer layer, the through hole portion 51 being provided with densely disposed through holes and the through hole portion 52 being provided with coarsely disposed through holes. The dense through hole portion 51 has a rectangular shape having one side coincident with a bent portion 54 forming one side edge of the packaging bag. On the other hand, the coarse through hole portion 52 is formed along a peripheral edge portion of the rough surface seal open portion 50 so as to surround the dense through hole portion 51 positioned inside the coarse through hole portion 52.

As mentioned above, by forming the coarse through hole portion 52 outside the dense through hole portion 51 so as to surround the outer periphery thereof, the packaging bag can be easily opened by tearing, by hands, the dense through hole portion 51. Incidentally, since the coarse through hole portion 52 is formed so as to surround the dense through hole portion 51, having a relatively small area occupying the rough surface seal open portion 50, percentage of erroneously tearing the dense through hole portion 51 can be reduced even at a time when the packaging bags are manufactured or a time when some projecting member or like collides with the rough surface seal open portion 50 during conveyance of the bags.

Further, the rough surface seal open portion 50 is formed apart from the lower end edge 53*a* of the upper seal portion 53 in the area of the upper seal portion 53. According to such structure, since the rough surface seal open portion 50 is positioned apart from the inner content accommodation space 55, a high barrier performance can be achieved. Such rough surface seal open portion 50 may be formed on one or both of the front and back surface portions of the packaging bag.

Figure 7:
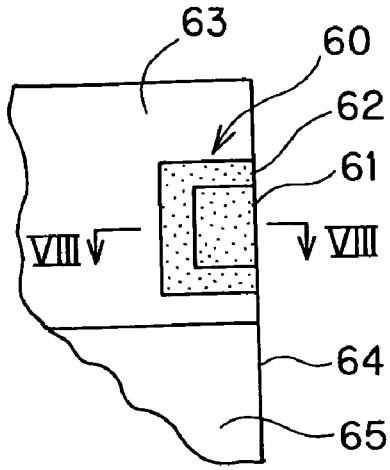
FIG. 7 is a plan view of a plan view showing the rough surface seal open portion having the recessed portion which includes a relatively shallow portion in depth.
Figure 8:
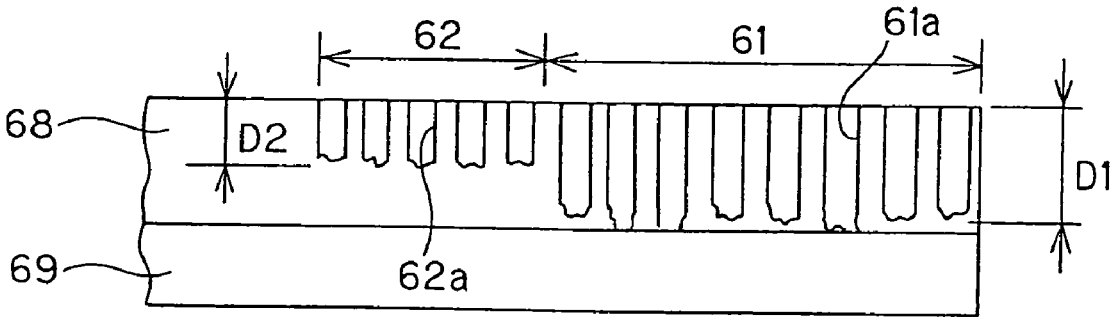
FIG. 8 is a sectional view taken along the line VIII-VIII in FIG. 7.

FIGS. 7 and 8 show another example of a rough surface seal open portion 60, which is composed of deep recessed portion 61 having recesses each having a deep depth and shallow recessed portion 62 having recesses each having a shallow depth. As shown in FIG. 7, the deep recessed portion 61 has a rectangular shape having one side according with a bent portion 64 forming one side edge of the packaging bag. On the other hand, the shallow recessed portion 62 is formed along a peripheral edge portion of the rough surface seal open portion 60 so as to surround the deep recessed portion 61. FIG. 8 is a schematic view showing a section of the film material to which the rough surface seal open portion 60 is formed. As shown in FIG. 8, each of recesses 61*a* of the deep recessed portion 61 has a deep depth D1 reaching near a boundary between an outer layer 68 and an inner layer 69, and in addition, the deep recessed portion 61 includes through holes each penetrating only the outer layer 68. On the other hand, each of recesses 62*a* of the shallow recessed portion 62 has a shallow depth D2 having a length approximately half of the length of the deep depth D1. Further, the recesses 61*a* and the through holes 61*b* formed to the deep recessed portion 61 are formed only to the outer layer 68 without reaching the inner layer 69.

As mentioned above, since the rough surface seal open portion 60 is composed of two portions including the deep recessed portion 61 and the shallow recessed portion 62, the strength of the deep recessed portion 61 is reduced relatively to the shallow recessed portion 62, thus capable of being easily torn with hands. On the other hand, the formation of the shallow recessed portion 62 so as to surround the deep recessed portion 61 can reduce the percentage for occurrence of erroneously tearing the deep recessed portion 61 even at a time when the packaging bags are manufactured or a time when some projecting member or like collides with the rough surface seal open portion 60 during conveyance of the bags.

Further, the rough surface seal open portion 60 of this example is also formed apart from the lower end edge 63*a* of the upper seal portion 63 in the area of the upper seal portion 63. Such rough surface seal open portion 60 may be formed on one or both of the front and back surface portions of the packaging bag.

Figure 9:
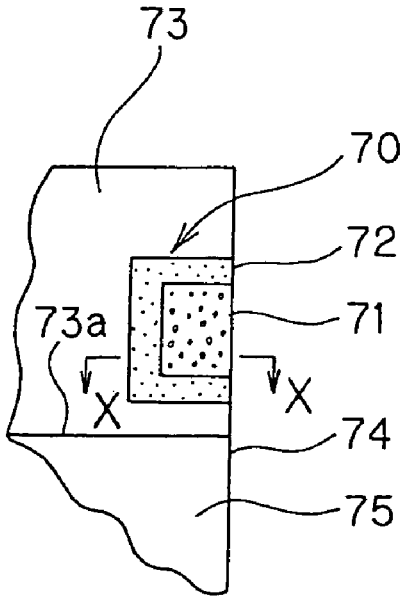
FIG. 9 is a plan view showing the rough surface seal open portion having a recessed portion including recesses which have sizes becoming relatively smaller along the peripheral edge thereof.
Figure 10:
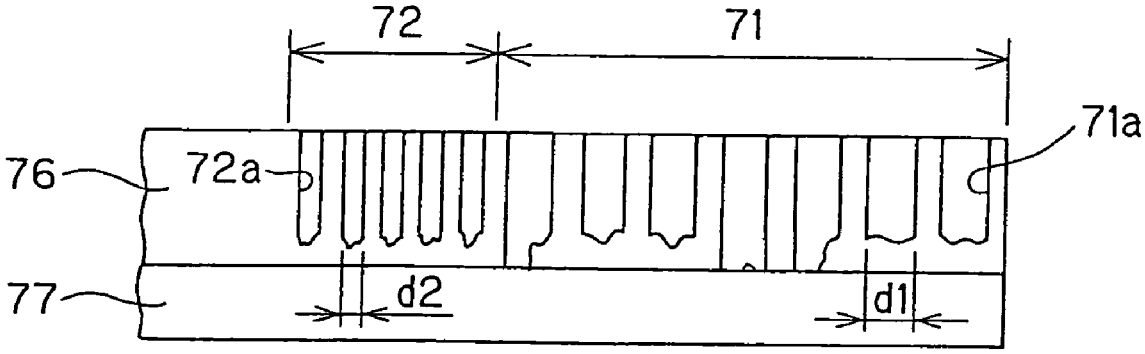
FIG. 10 is a sectional view taken along the line X-X in FIG. 7.

FIGS. 9 and 10 show a packaging bag having a rough surface seal open portion 70 according to a further embodiment of the present invention. The rough surface seal open portion 70 is composed of aggregated portions (which may be called as aggregations hereunder) 71 and 72, in which the aggregated portion 71 includes recesses each having a relatively large diameter d1 formed to the outer layer 76 and through holes penetrating the outer layer (both being designated as 71*a*), and the aggregated portion 72 includes recesses 72*a* each having a relatively small diameter d2. As shown in FIGS. 9 and 10, the aggregated portion 71 including the large diameter-recesses and through holes 71*a* has a rectangular shape having one side portion formed at one side edge as bent portion 74. The aggregated portion 72 including the small diameter-recesses 72*a* is formed along the peripheral edge portion of the rough surface seal open portion 70 so as to surround the periphery of the aggregated portion 71 of the large diameter-recesses and through holes 71*a*. Further, with this rough surface seal open portion 70, the recesses and through holes 71*a* and the recesses 72*a* do not reach the inner layer 77 and are formed only to the outer layer 76 (FIG. 10).

As mentioned above, according to the described embodiment, in which the rough surface seal open portion 70 is composed of the aggregated portion 71 including the relatively large recesses and through holes 71*a* and the aggregated portion 72 including the relatively small recesses 72*a*, it becomes possible to relatively reduce the strength of the aggregated portion 71 including the relatively large recesses and through holes 71*a* and to relatively increase the strength of the aggregated portion 72 including the relatively small recesses 72*a*. Thus, the aggregated portion 71 including the relatively large recesses and through holes 71*a* can be easily torn with hands, and on the other hand, with the aggregated portion 72 including the relatively small recesses 72*a*, the percentage of occurrence of erroneously tearing this portion can be reduced even at a time when the packaging bags are manufactured or a time when some projecting member or like collides with the rough surface seal open portion 70 during conveyance of the bags.

Furthermore, the rough surface seal open portion 70 is also formed apart, to the upper side, from the lower end edge 73*a* of the upper seal portion 73 in an area in which the upper seal 73 is formed. In addition, this rough surface seal open portion 70 may be also formed on one or both of the front and back surface portions of the packaging bag as mentioned before.

Figure 11:
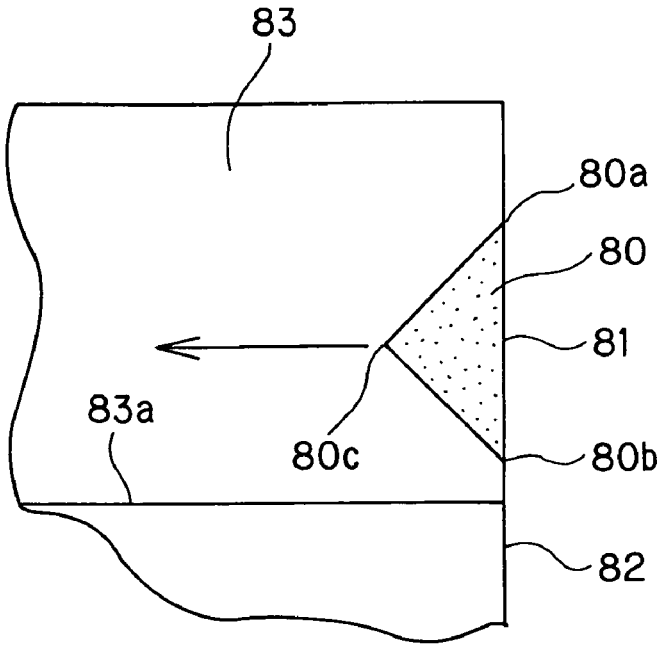
FIG. 11 is a view showing an example of the rough surface seal open portion formed so as to gradually protrude towards a center in a width direction of the packaging bag from upper end and lower end portions of the rough surface seal open portion in a vertical direction thereof.
Figure 12:
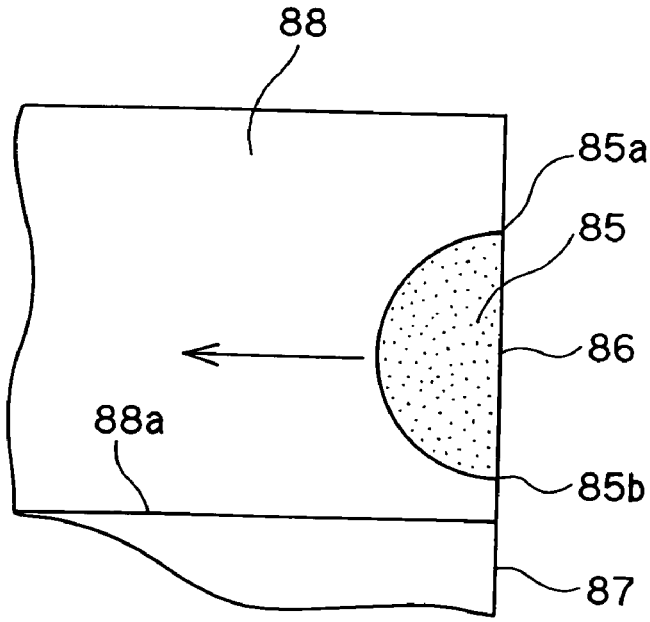
FIG. 12 is a view showing a rough surface seal open portion other than that shown in FIG. 11.

In the above disclosure, although the embodiment in which the rough surface seal open portion has a rectangular shape was described, the rough surface seal open portion may be formed, as shown in FIGS. 11 and 12, so that the end portion thereof gradually protrudes towards the central portion of the packaging bag in its width direction from the upper and lower end portions thereof in its vertical direction.

FIG. 11 shows a rough surface seal open portion 80 having a triangular shape and including a bottom side 81 of the triangle, which accords with a bent portion 82 constituting one side edge portion of the packaging bag. The rough surface seal open portion 80 has upper and lower end portions 80*a* and 80*b* are positioned on the bent portion 82. The rough surface seal open portion 80 gradually projects or protrudes from these upper and lower end portions 80*a* and 80*b* towards the central portion of the packaging bag in its width direction, and the projected central portion 80*c* constitutes the apex of the triangle.

Further, the rough surface seal open portion 80 shown in FIG. 11 is formed within the area of the upper seal portion 83 of the rough surface seal open portion 80 at a portion apart, to the upper side, from the lower end edge 83*a* of the upper seal portion 83.

FIG. 12 shows a rough surface seal open portion 85 having a semi-circular shape and including a bottom side 86, corresponding to a diameter portion, of the semi-circular shape which accords with a bent portion 87 constituting one side edge portion of the packaging bag. The rough surface seal open portion 85 has upper and lower end portions 85*a* and 85*b* positioned on the bent portion 87. The rough surface seal open portion 85 is formed so that the peripheral portion thereof protrudes towards the central portion of the packaging bag in its width direction from the upper and lower end portion thereof, and the semi-circular shape in this embodiment may be substituted with one having a semi-elliptical shape.

In the embodiments shown in FIGS. 11 and 12, in which the rough surface seal open portions are formed so as to gradually protrude centrally towards the central portion in the width direction of the packaging bag from the upper and lower end portions of the rough surface seal open portion, so that the rough surface seal open portion can be formed with small area without deteriorating the easy seal opening function. By making small the rough surface seal open portion, the percentage of applying some external force to this rough surface seal open portion can be reduced and an opportunity of erroneously tearing this portion can be also reduced.

The rough surface seal open portion 85 shown in FIG. 12 is also formed in the area of the upper seal portion 88, and moreover, at a portion apart to the upper side from the lower end edge 88*a* of the upper seal portion 88.

A packaging bag according to another embodiment of the present invention will be described hereunder with reference to FIGS. 13 and 14.

The packaging bag 100 has a structure basically identical to the packaging bag 1 shown in FIG. 1, in which one sheet of film material is bent at two portions to be parallel so that end portions of the film sheet abuts to each other. Both the abutting end portions are bonded together so as to provide a tubular structure having upper and lower end openings which are sealed.

The packaging bag 100 has a front surface 102 and a back surface 103 opposing thereto, and upper and lower end edge portions of the packaging bag 100 are formed as upper and lower seal portions 105 and 109 along the end edge portions respectively by heat sealing the front and back surfaces 102 and 103. The side edge portions of the packaging bag 100 are formed as bent portions 115 and 116 of the film material. In addition, the side edge portions of the film material are mated and bonded to each other so as to form a back seal portion 104 extending vertically (longitudinally) of the packaging bag 100.

The lower seal portion 109 is formed by heat sealing the front surface 102 and the back surface 103 from the lower end edge with a predetermined width. On the other hand, the upper seal portion 105 is formed with a two-staged portion, in its width direction, including deep seal portion and shallow seal portion having lengths from the upper end portion of the packaging bag 100.

The deep seal portion is formed as first seal portion 106 which has a relatively deep depth from the upper end edge portion and which occupies an area including the bent portion 115 being one side edge portion of the packaging bag 100 and an area on the side of the bent portion 115 from the central back seal portion 104. On the other hand, the shallow seal portion is formed as second seal portion 107 which has a relatively shallow depth from the upper end edge portion and which occupies an area including an area between the first seal portion 106 and the other bent portion 116 being the other side edge portion of the packaging bag 100. As shown in FIG. 13, in the upper seal portion 105, the second seal portion 107 has the area wider, in the width direction, than the first seal portion 106.

A rough surface seal open portion 110 is formed to the bent portion 115 constituting one side edge portion to which the first seal portion 106 is formed. This rough surface seal open portion 110 is formed so as to include the bent portion 115 as one side edge portion. In addition, the rough surface seal open portion 110 is formed apart upward from the lower end edge of the first seal portion 106 in the formation area thereof. Further, with the rough surface seal open portion 110 of this embodiment, although the rough surface seal open portions 110 are formed to both the front surface portion 102 and back surface portion 103 with the bent portion 115 being the center thereof, the rough surface seal open portion 110 may be formed only to one of the front and back surface portions 102 and 103 as long as the bent portion 115 is included.

Incidentally, an intermediate rough surface seal open portion 111 formed to the root portion of the back seal portion 104 is disposed so as not to be included in the second seal portion 107. This intermediate rough surface seal open portion 111 is formed on the side lower than the lower end edge of the second seal portion 107 in the vertical (longitudinal) direction of the packaging bag 100 and in a level substantially equal to the rough surface seal open portion 110 in the area on the side upper than the lower end edge of the first seal portion 106. The intermediate rough seal open portion 111 is also formed to a portion, of the back seal portion 110, opposing to the bent portion 116 constituting the other side edge portion on the side reverse to the bent portion 115 to which the rough surface seal open portion 110 is formed.

Figure 13:
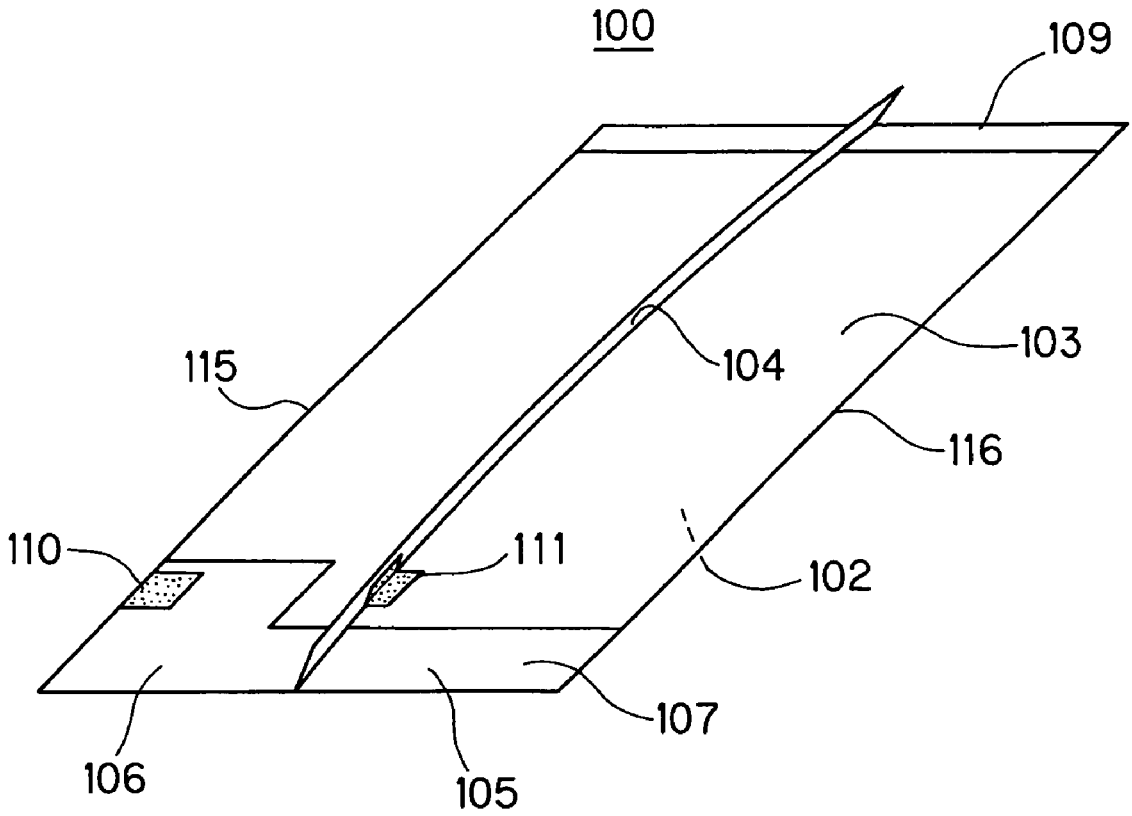
FIG. 13 is a perspective view formed with an upper seal portion so as to provide a large pouring portion.
Figure 14A:
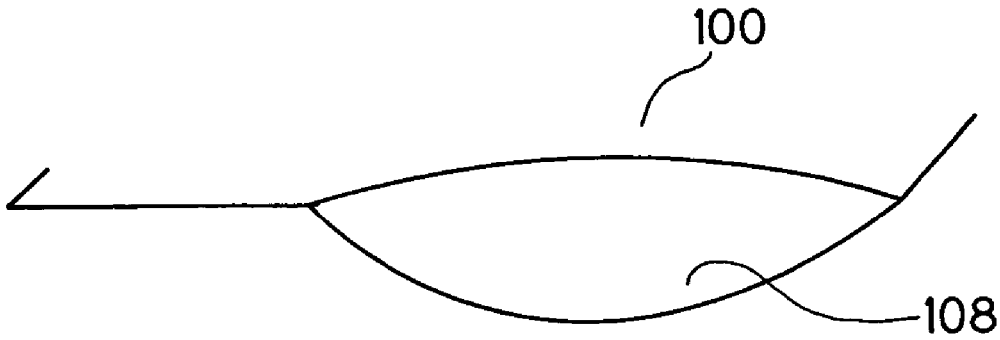
FIG. 14 is a view showing comparison of an opened state of the packaging bag.
Figure 14B:
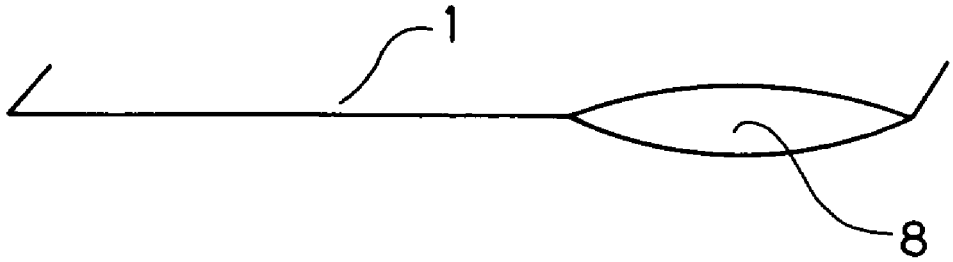

By forming the second seal area to be larger than the first seal area as in the packaging bag shown in FIG. 13, the pouring opening can be made large as shown in FIG. 14, in which FIG. 14(*a*) shows a pouring opening 108 formed by opening the sealed portion of the packaging bag 100 shown in FIG. 13 and FIG. 14(*b*) shows the pouring opening 8 formed by opening the sealed portion of the packaging bag 1 already shown in FIG. 1. As shown in FIG. 14, the pouring opening 108 is far larger than the opening 8.

In a case that the inner content accommodated in the packaging bag is liquid, the content can be poured out smoothly even if the pouring opening has a relatively small size as shown in FIG. 14(*b*). However, in a case that the inner content accommodated in the packaging bag is particles or like substance, there is a possibility of clogging the opening and it may become difficult to smoothly take out the content. Accordingly, in the case that the particular substance is accommodated in the packaging bag, it is preferred to use the packaging bag 100 having the large pouring opening 108 as shown in FIG. 13.

Figure 15:
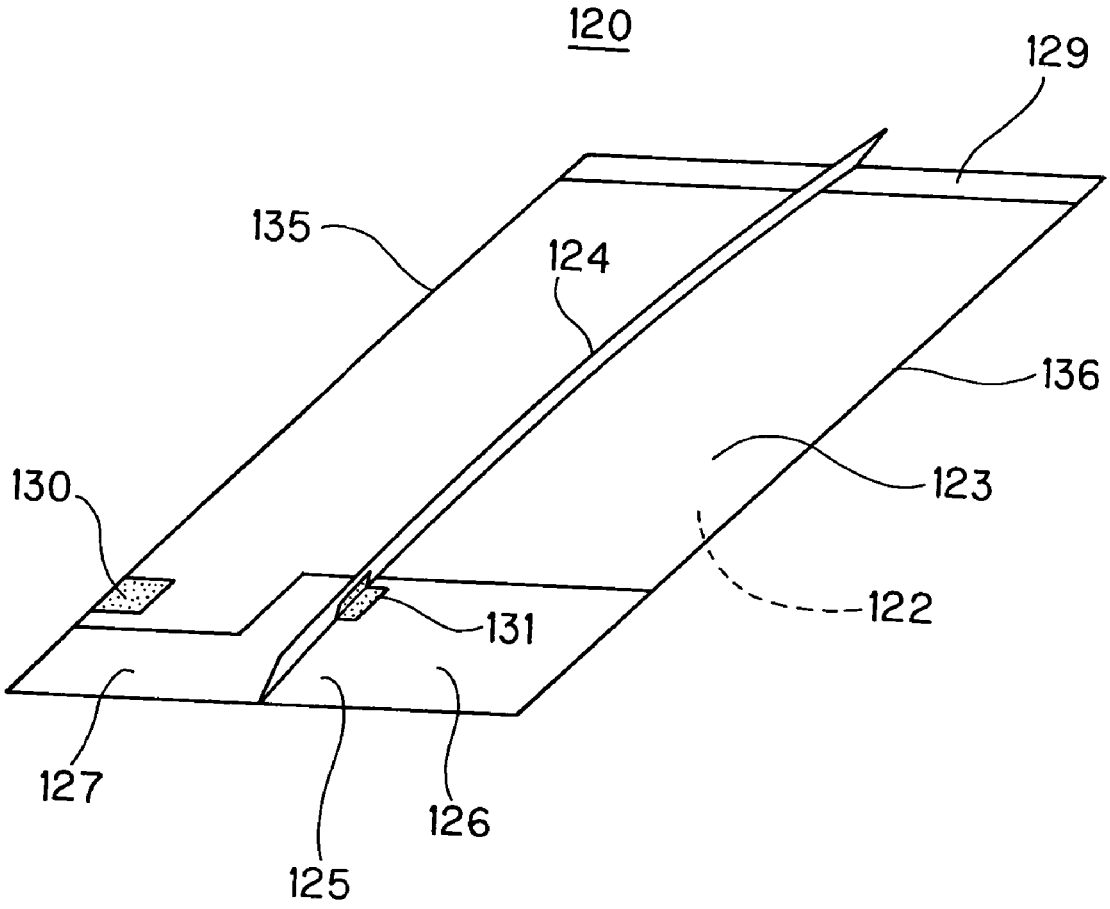
FIG. 15 is a perspective view of a packaging bag according to a further embodiment of the present invention.

FIG. 15 represents a packaging bag 120 according to another embodiment of the present invention.

The packaging bag 120 also has a structure, in which one sheet of film material is bent at two portions to be parallel so that end portions of the film sheet abuts to each other. Both the abutting end portions are bonded to each other so as to provide a tubular structure having upper and lower end openings which are sealed. The packaging bag 120 has a front surface portion 122, which is disposed as back side surface in FIG. 15, a back surface portion 123 opposing thereto, an upper seal portion 125 sealing the upper portion of the bag, a lower seal portion 129 sealing the lower portion thereof, and a back seal portion 124 formed by bonding together the side edge portions of the film material. This packaging bag 120 has both side edge portions formed as bent portions 135 and 136.

The lower seal portion 129 is formed by heat-sealing the front and back surfaces 122 and 123 from the lower end edge portions thereof by a predetermined width. The upper seal portion 125 is, on the other hand, formed with a first seal portion 126 having a relatively deep depth from the upper end edge and a second seal portion 127 having a relatively shallow seal depth, both being arranged side by side in the width direction of the packaging bag 120.

In this packaging bag 120, the second seal portion 127 having the relatively shallow seal depth from the upper end edge thereof is formed in an area between the one bent portion 135 forming one side edge of the bag 120 and a portion slightly on the side of the bent portion 115 from the central back seal portion 124. On the other hand, the first seal portion 126 having the relatively deep seal depth is formed in an area between the second seal portion 127 and the other bent portion 116 forming the other side edge of the bag 120.

A rough surface seal open portion 130 is formed to the one bent portion 135 forming the one side edge of the second seal portion 127. This rough surface seal open portion 130 is formed so as to include the bent portion 135 constituting the one side edge of the packaging bag 120. Further, with the rough surface seal open portion 130 of this embodiment, although the rough surface seal open portions 130 are formed to both the front surface portion 122 and back surface portion 123 with the bent portion 135 being the center thereof, the rough surface seal open portion 130 may be formed only to one of the front and back surface portions 122 and 123 as long as the bent portion 135 being included.

Incidentally, an intermediate rough surface seal open portion 131 formed to the root portion of the back seal portion 124 is disposed in the first seal portion 126. This intermediate rough surface seal open portion 131 is formed in a level substantially equal to the rough surface seal open portion 130 in vertical (longitudinal) direction of the packaging bag 120. The intermediate rough seal open portion 131 is also formed to a portion, of the back seal portion 130, opposing to the bent portion 136 constituting the other side edge portion on the side reverse to the bent portion 135 to which the rough surface seal open portion 130 is formed.

Furthermore, the rough surface seal open portion of the packaging bag shown in FIGS. 13 to 15 may have shapes shown in FIGS. 6 to 12 as occasion demands.

Hereinabove, although the embodiments of the packaging bags having upper sealed portions to be opened including the pillow-type bag and three-side seal bag are mentioned, such rough surface seal open portion may be formed to a central portion of a bag swelled by the content accommodated in the bag such as coffee drip paper.

As mentioned above, according to the present invention, by providing the rough surface portion from which the sealed portion is easily opened, i.e., rough surface seal open portion, the packaging bag can be extremely easily opened. The seal opening starting portion is formed by performing the surface roughing treatment, so that the outer appearance of the bag is not damaged. Moreover, possibility of erroneously opening the sealed portion can be extremely reduced in comparison with a case that a cutout for opening is formed.

Furthermore, with the pillow type packaging bag having a back seal portion, the intermediate rough surface seal open portion is formed, so that the seal opening can be smoothly done to the back seal portion.

In addition, in the case that the rough surface seal open portion and the intermediate rough surface seal open portion are formed independently from the portion constituting the inner content accommodation space, such space is not affected by the formation of the surface roughing treatment, and hence, the packaging bag can provide extremely high barrier performance.

Still furthermore, in the packaging bag formed with the first seal portion having relatively shallow seal depth and the second seal portion having relatively deep seal portion, the size of inner content pouring opening can be made large by making large the second seal portion area than the first seal portion area in the width direction of the packaging bag.

Further, in the present invention, the recessed portion having coarse density of arrangement of the recesses is formed along the peripheral edge of such rough surface seal open portion, the portion having the relatively shallow recessed portion is formed along the peripheral edge portion thereof, or the portion having a relatively small-sized recessed portion is formed to the peripheral edge portion thereof. Accordingly, by relatively increasing the strength of the peripheral portion, the portion to be readily torn can be made small, while maintaining the readily tearing performance, and the percentage of being torn when some sharp ended material collides with the bag can be reduced.

In addition, by forming the rough surface seal open portion so as to gradually protrude towards the central portion in the width direction of the packaging bag from both the upper and lower portions of the rough surface seal open portion, the packaging bag can be more easily torn.

The invention claimed is:

1. A packaging bag, comprising:

a laminate film bent at two portions parallel to each other such that ends of the two portions are mated to each other the mated ends being bonded together so as to provide a tubular body having upper and lower openings, and upper and lower seal portions extending across the upper and lower openings in a width direction of the packaging bag and sealing the upper and lower openings, respectively, wherein said two bent portions of the laminate film comprise side edge portions the side edge portions being boundaries between a front surface portion and a back surface portion of a packaging bag so that the mated end portions are bonded together with a predetermined width on the back surface side of the packaging bag thereby forming a back seal portion, said upper seal portion includes first and second seal sections, the first seal section extending from a first side edge portion across the back seal portion and having a relatively deep depth in a vertical direction of the front and back surface portions relative to the second seal section, the second seal section extending between the first seal section and a side edge portion of the packaging bag opposite the first side edge portion in the width direction and having a relatively shallow depth compared with the first seal portion in a vertical direction of the front and back surface portions, said first seal section has a rough surface seal open portion on one of the side edge portions of at least one of the front and back surface portions of the packaging bag, the rough surface seal open portion comprising a plurality of fine recesses in an outer layer of the laminate film and a plurality of fine through holes penetrating the outer layer, and said first seal section has an intermediate rough surface seal open portion in the back surface portion including a root portion of the back seal portion where the back seal portion meets the back surface section, the intermediate rough surface seal open portion comprising a plurality of fine recesses in the outer layer of the laminate film and a plurality of fine through holes penetrating the outer layer.

2. The packaging bag according to claim 1, wherein said rough surface seal open portion is formed so as to gradually protrude towards a central portion in the width direction of the packaging bag from upper and lower end portions in the vertical direction of the rough surface seal open portion.

3. The packaging bag according to claim 1, wherein said rough surface seal open portion is provided with a portion, at which the recesses are formed coarsely in density, along a peripheral edge portion of the rough surface seal open portion.

4. The packaging bag according to claim 1, wherein said rough surface seal open portion is provided with a portion, at which the recesses having a relatively shallow depth are formed, along a peripheral edge portion of the rough surface seal open portion.

5. The packaging bag according to claim 1, wherein said rough surface seal open portion is provided with a portion, at which the recesses having a relatively small size are formed, along a peripheral edge portion of the rough surface seal open portion.

* * * * *